United States Patent [19]

Tribolet

[11] 4,310,945

[45] Jan. 19, 1982

[54] VACUUM EXTRACTION RECOVERY SYSTEM ASSEMBLY

[76] Inventor: Herbert Tribolet, 2671 Paradise Way, Grand Junction, Colo. 81501

[21] Appl. No.: 47,409

[22] Filed: Jun. 11, 1979

Related U.S. Application Data

[63] Continuation of Ser. No. 782,137, Mar. 28, 1977, Pat. No. 4,167,800.

[51] Int. Cl.[3] ..... A47L 9/10

[52] U.S. Cl. ..... 15/347; 15/327 F; 15/353

[58] Field of Search ..... 15/320, 321, 327 R, 15/327 F, 331, 347, 352, 353

[56] References Cited

U.S. PATENT DOCUMENTS

| | | | |
|---|---|---|---|
| 963,139 | 7/1910 | Griffiths | 15/353 X |
| 2,306,212 | 12/1942 | Gerstmann | 15/353 X |
| 2,539,867 | 1/1951 | Schnabel | 15/353 X |
| 2,635,277 | 4/1953 | Belknar | 15/353 X |
| 3,055,039 | 9/1962 | Smith | 15/353 |
| 3,180,071 | 4/1965 | Nolte | 15/353 X |
| 3,343,199 | 9/1967 | Nolte | 15/321 X |
| 3,505,703 | 4/1970 | Miller et al. | 15/347 X |
| 3,584,330 | 6/1971 | Wallin et al. | 15/353 X |
| 3,828,930 | 8/1974 | Cater | 15/321 |
| 3,840,935 | 10/1974 | Fitzgerald et al. | 15/322 |
| 3,896,521 | 2/1975 | Parise | 15/321 |
| 3,911,524 | 10/1975 | Parise | 15/321 X |

*Primary Examiner*—Chris K. Moore

*Attorney, Agent, or Firm*—Arthur A. March

[57] ABSTRACT

Vacuum extraction recovery system assembly comprising a compartmentalized vacuum housing having a substantially air tight exterior wall, a vacuum creating mechanism in a first lateral portion of the housing interior, and a wall surface containing a constantly, directly and continuously freely open flow aperture therein and defining together with an adjacent portion of the exterior wall thereat an interior vacuum compartment in a second lateral portion of the housing interior which is laterally remotely spaced from the vacuum creating mechanism, such that the compartment is in constant, direct and continuous freely open flow communication with the remainder of the housing interior through such flow aperture and thereby constantly, directly and continuously maintained under vacuum condition corresponding to that in the remainder of the housing interior when a vacuum is created therein by the vacuum creating mechanism, for instance with the exterior wall having an access opening directly communicating with the compartment which is closed by a removable closure insert element, such as a recovery tank, for flow connection with an external vacuum hose and arranged for flow communicating the exterior with the flow aperture through the insert element, its outlet and the compartment for recovery in the assembly of vacuum extracted material entering through the inlet, and spacing structure in the housing for maintaining the outlet in raised open flow relation to the bottom flow portion of the housing interior.

9 Claims, 8 Drawing Figures

VACUUM EXTRACTION RECOVERY SYSTEM ASSEMBLY

This is a continuation of copending patent application U.S. Ser. No. 782,137, filed Mar. 28, 1977, now U.S. Pat. No. 4,167,800 issued Sept. 18, 1979.

BACKGROUND OF THE INVENTION

There have been many variations of devices for cleaning rugs and other surfaces. These surfaces have been conventionally cleaned either by dry vacuum cleaning devices or hot water extraction units sometimes called "steam" cleaners. These devices are of a multitude of different sizes and shapes and completely separate units were most times provided for a dry vacuum cleaning operation and for a hot water extraction unit. Some attempts have been made to provide a system in which the same means are utilized, at least in some respects, for the dry vacuum cleaning operation as well as for the hot water extraction wet cleaning operation. However, in most such units, there has been little, if any, provision for using substantially the same unit for dry vacuum cleaning as well as for wet cleaning systems, or if such proposals have been made they were somewhat complex in the form of dual containers or separate containers for providing the vacuum and/or recovering the used chemically-laden water. As a result, the units heretofore proposed involve some considerable expense and the average user has not received the benefits of using substantially a single unit for regular dry vacuum cleaning and the hot water extraction.

SUMMARY OF THE INVENTION

The present invention overcomes the foregoing problems and presents a highly desirable structural arrangement in which a complete dry and wet system may be provided utilizing one relatively small housing having a receptacle for functioning as a dry vacuum cleaner. Also, with the same vacuum means, the same housing, and the same basic structural arrangements, the unit functions as a wet cleaning system by merely inserting a recovery tank into the receptacle. This cleaning system contemplates the use of an appropriate vacuum means disposed and located within the housing which will function for the creation of vacuum conditions whether the system is being utilized as a dry vacuum cleaner or a hot water extraction unit.

In accordance with the inventive concept, the vacuum-creating means in the form of a vacuum motor is affixed within the housing and, when operating, creates a vacuum throughout the interior of the housing. The vacuum pump itself may be of any conventional type. The housing itself is divided into compartments either by a partitioning wall or by the provision of a receptacle within the housing. The vacuum motor is disposed within one compartment of the housing. The second compartment which is open at the top, is provided with a cover in order that it may be relatively sealed when desired. An inlet opening is located in the side wall of the second compartment and in the adjacent side wall of the receptacle when such structure provides the second compartment. The inlet opening(s) accommodate a hose for use with a dry vacuum tool. When the unit is being used as a dry vacuum cleaner, a conventional vacuum bag is attached to the interior end of the aforesaid hose and is disposed within the second compartment. When the vacuum is created by the vacuum motor within the first compartment, a vacuum condition will also be created in the second compartment which accommodates the vacuum bag. Thereupon, through means of a conventional hand tool, a rug or other surface may be ∓vacuum cleaned" with dispatch and facility. The second compartment is, as aforesaid, provided with an aperture leading into the first compartment so that the vacuum condition in the first compartment may also be provided in the second compartment of the housing.

When it is desired to use the same system and device as a wet cleaning system or hot water extraction unit, the cover on the second compartment is removed and a recovery tank is disposed within that area. The exterior walls of the recovery tank are in close engagement with the interior walls of the second compartment and the hose used for the conventional dry cleaning operation leading into the second compartment is closed by means of a cap or other suitable means. The recovery tank has a riser tube extending into the recovery tank. The base of the riser tube and the adjacent portion of the recovery tank are open so as to be subject to the vacuum conditions in the housing. Suitable means are provided to enable the application of chemically-laden water to the rug or the surface of the floor. Such means may be attached to a conventional faucet, or any other desired method supplying the chemically-laden liquid may be utilized.

The recovery tank is provided with a dome having an inlet in its cover portion or at any other suitable place leading into the recovery tank. The inlet is provided interiorly of the recovery tank with a downwardly extending deflector. The upper end of the riser tube carries a filter means.

When the cleaning system of the present invention is to be used for hot water extraction, the same vacuum conditions, as above described, are created within the housing. These vacuum conditions are also thereby created in the recovery tank via the riser tube thereby drawing the liquid previously applied to the rug or other surface up through a hand tool and into the recovery tank. Thus, a compact, efficient and extremely functional unit is provided in which substantially the same basic means are used for a dry vacuum cleaning operation and wet cleaning system with the latter being accomplished merely by the insertion of a recovery tank into the already provided receptacle. The unit may be so compact in size as to be easily manipulatable by a person engaged in household, non-industrious cleaning.

Hereinafter reference will be made a specific embodiments of the present invention taken in conjunction with the following drawings. This description and the illustrations are not to be considered as a limitation upon the scope of the invention but merely to facilitate an understanding thereof.

DETAILED DESCRIPTION OF THE INVENTION

Figure 1:
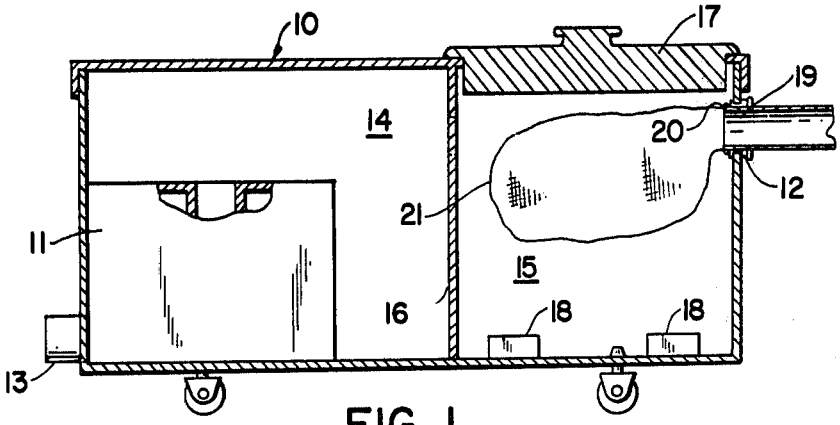
FIG. 1 is a side view partly in section of the cleaning device of the system of the present invention used as a dry vacuum cleaner.

The cleaning system of the present invention comprises a housing 10 in which a vacuum motor 11 is disposed. The entire unit is movable on wheels as illustrated. The housing may be of any desired shape or material which would enable it to be moved in compact form from place to place with ease and facility and has an access opening 12 in its upper wall. Suitable exhaust means 13 lead from the vacuum motor to the exterior of the housing. A conventional pump (not shown) is used to create a vacuum.

The housing 10 is divided into two compartments 14 and 15 by a dividing wall 16 or any other suitable means. The first compartment 14 accommodates the vacuum creating means 11. The other or second compartment 15 has the access opening 12 in the otherwise air tight exterior wall of the housing 10. A removable cover 17 is provided to maintain a closable relatively air tight seal within the compartments 15 and 14 for the purposes hereinafter set forth. Supporting members 18 are also provided within compartment 15.

An inlet 19 extends through the side wall of the compartment 15. The inner end 20 of the inlet is adapted to receive a conventional air flow permeable and dust and debris collecting dry recovery vacuum bag 21, and the outer end of the inlet is attachable to a conventional hand held dry vacuum tool (not shown).

When the vacuum motor is operated through a conventional electrical outlet (not shown), it is of suitable strength to cause a vacuum to be created within the entire interior of the relatively air tight housing 10. The vacuum is created in compartment 14 and by means of the apertures **16*a*, this vacuum condition is also created within the compartment 15. This action causes the air and accompanying dirt and debris to be drawn from the rug or other surfaces through the vacuum tool and the inlet 19 into the bag 21** whereupon the rug or other surfaces may be dry vacuum cleaned. Thus the conventional user may utilize this very compact unit for the oft-repeated dry vacuum cleaning requirements around a household. The cleaning system is manipulatable and easily movable from place to place as desired.

When it is desired to use this same system for wet cleaning as a hot water extraction unit, only a slight modification to the system is required. The basic system above described is utilized, that is, the housing 10 and vacuum motor 11 remain as above described without change. For the less frequent wet cleaning of rugs or other surfaces, the cover 17 is removed from the compartment 15 and a wet recovery vacuum tank 24 is inserted into the receptacle. When this use is contemplated, the inlet 10 may be closed by means of a cap 25 or other suitable means. The recovery tank 24 has an internal riser tube 26 extending from an aperture 27 in the base of the tank. The tank is so disposed that it fits relatively snugly within the interior of the compartment 15 but some space is left adjacent the wall 16 to permit the introduction of the condition existing in compartment 14 into compartment 15 of housing 10. The tank 24 rests upon the supports 18 leaving a space between the bottom of the tank and the floor of the compartment 15. The tank comprises two portions, i.e. a lower portion or base 28 and a removable cover 29, both of which may be made of any suitable material. A sealing ring 30 is provided at the joinder of the cover and the base of the tank for preventing the ingress of air at the juncture of these two parts. The removable cover 29 may merely rest on the sealing ring 30 situated on the enlarged lip of the base 28 to effect an air tight relation between these parts, yet preferably will be held in place by conventional releasable fastening clips (not shown) or the like or any suitable means to insure against undesired dislodgement even though the separation of the cover and base at the sealing ring will be aided by the pressure differential created by the vacuum condition within the recovery tank 24 during use.

Figure 4:
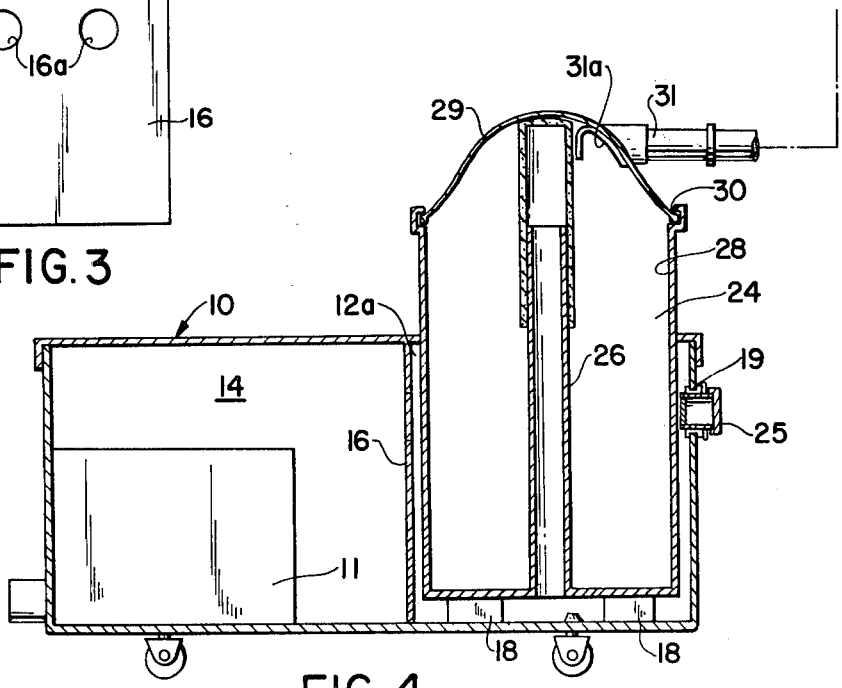
FIG. 4 is a side view partly in section of the cleaning device of the system of the present invention for use as a hot water extraction unit.
Figure 5:
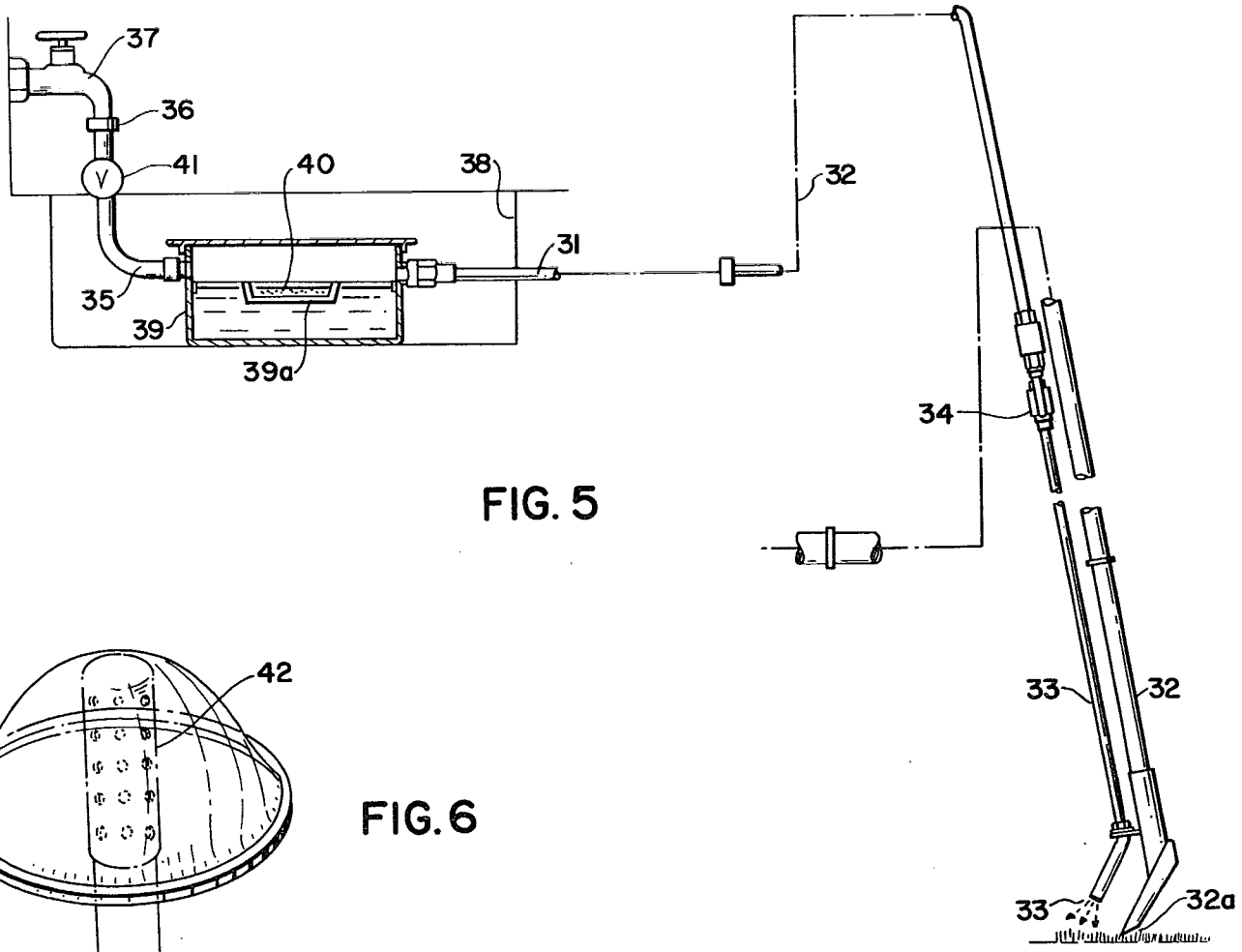
FIG. 5 is a plan view of the various structural elements comprising the means for applying the chemically-laden liquid to a rug or other surface and the hand tool for removing the liquid.
Figure 6:
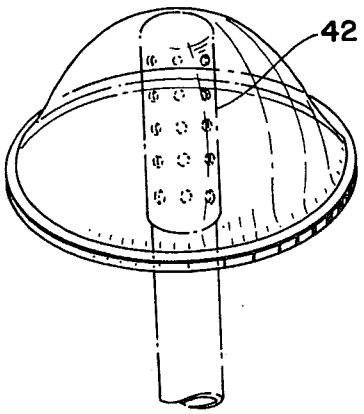
FIG. 6 is a view of the filter cartridge used with the cleaning device of the system of the present invention in position on the riser tube of the recovery tank.

An inlet 31 is disposed, preferably within the cover, although if desired it could be provided in the lower portion of the tank itself. The inner end of the inlet is coupled to a deflector **31*a* for the purposes hereinafter set forth. The other end of the inlet 31 is connected to a water extractor 32, as shown in FIG. 4. A water applicator 33 is disposed adjacent to the water extractor 32. A manually adjustable valve 34 is located at the upper end of the water applicator 33** so that the user can control the amount of liquid which is placed on the surface to be cleaned.

The upper end of the applicator carries another hose 35 which is adapted to be affixed by a universal coupling 36 to any suitable water outlet such as the normal faucet 37 of a sink 38. The hose 35 is of such length that it can conveniently reach from the most easily accessible water outlet to any place in the home in which cleaning is taking place and may be simply coupled to and uncoupled from the faucet to accomplish this purpose.

Also located in the line leading from the faucet 37 to the head of the water applicator 33 is a suitable reservoir or container 39 which may be disposed in the sink 38 or at any other convenient location along the line. The container has therein a solution of any preferable cleaning chemical 40 and as the water passes through the container it picks up selectively from the flow permeable or perforated tray **39*a* and carries with it, e.g. is entrained or dissolved form, a certain amount of the cleaning chemical, such as a powdered detergent, to be emitted upon the surface to be cleaned through the outlet of the water applicator 33 at the normal water outlet hydraulic delivery pressure. A metering valve 41, however, is locatable within the hose 35 so that only a predetermined amount of water under a thus controllable hydraulic delivery pressure can pass into the line leading to the outlet 29*a*** for alternate emission and cleaning. Thus, a completely detachable but easily movable apparatus is provided which can utilize the normal water outlet and its associated normal outlet hydraulic delivery pressure as well as a relatively conventional vacuum canister for providing the hot water extraction cleaning system of the present invention.

The operation of the device of the present invention is as follows: When the vacuum motor 11 is energized a vacuum is created within the compartment 14. The vacuum motor is of sufficient power to cause a vacuum condition appropriate for the fuctnion herein set forth. By means of the apertures 16*a*, this vacuum condition is also created within the compartment 15 and thereby through the inlet 19 to the vacuum tool (not shown). Thus, the dust and other debris which is on a rug or other surface to be cleaned is drawn into the conventional air flow permeable and solids particle deposition vacuum bag 21 and the relatively small compact unit may be moved from place to place according to the desires of the user. As a consequence, the normal conventional dry cleaning may be accomplished readily and with facility.

The efficient and compact unit may be converted to a hot water extraction unit or wet cleaner system by simply removing the cover 17 from the compartment 15 and placing therein the recovery tank 24 of the description hereinbefore set forth. When this tank is inserted, a cap 25 or other suitable flow occluding means is used to cover the inlet 19. There is a snug air tight fit between the aperture edges 12*a* and the exterior of the vacuum tank 24. Below this abutting engagement there is sufficient clearance between the wall 16 and the exterior of the tank 24 to permit the transfer of conditions existing in compartment 14 and compartment 15. Thus, any vacuum created in compartment 14 will in turn be created in compartment 15 and thereupon in the recovery tank 24 via riser tube 26. Thus, by reason of the independent air tight condition of the recovery tank 24, the vacuum created in the housing 10 when the motor 11 is energized will thereby cause a vacuum condition within the recovery tank 24. The vacuum created in the tank 24 causes a vacuum to be created via inlet 31 as well as in the extractor tool 32. As shown, the head of the xtractor 32 is in proximity to the applicator 33. Therefore, when a desired amount of liquid containing the cleansing solution is applied to the surface to be cleaned through the spray outlet 33*a*, the suction created at the suction mouth 32*a* of the extractor 32 traveling adjacent thereto causes the solution which has cleaned the surface to which it has been applied to be drawn into the tank 24.

The deflector 31*a* serves to deflect the liquid entering the tank 24 away from the riser 26 and thereby prevent any of the solution from passing into the riser and consequently into the housing 10.

The present invention therefore utilizes a very efficient construction for utilizing a vacuum receptable which is adapted to be connected to the water inlet from a convenient water tap and pass through a cleaning chemical for ultimate containment within a separate and disconnectable tank after performing the cleaning operation. The tank, of course, may be easily cleaned after the water is removed and is thereafter easily stored. As a consequence, the relatively inexpensive unit is ready for use when necessary during the portions of the year when major cleaning is undertaken.

A filter cartridge 42 is disposed over the riser tube to efficiently filter any dirt or debris which may pass into and circulate within the recovery tank 24. This prevents such dirt and debris from accumulating within the housing 10 and from being drawn into the vacuum motor 11 thus eliminating the possibility of any damage to the motor by such debris or dirt, wet or dry in nature.

It is to be noted that the various specifics of the receptacle, recovery tank, housing and motor illustrated and described are only for the purpose of illustration and the concept may be utilized in a great variety of sizes, shapes and constructions.

Figure 7:
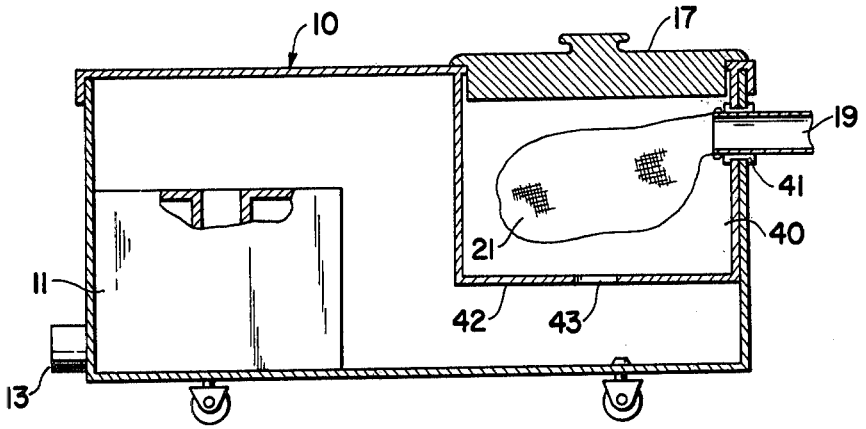
FIG. 7 is a side view partly in section of a modified form of the cleaning device of the system of the present invention used as a dry vacuum cleaner.
Figure 8:
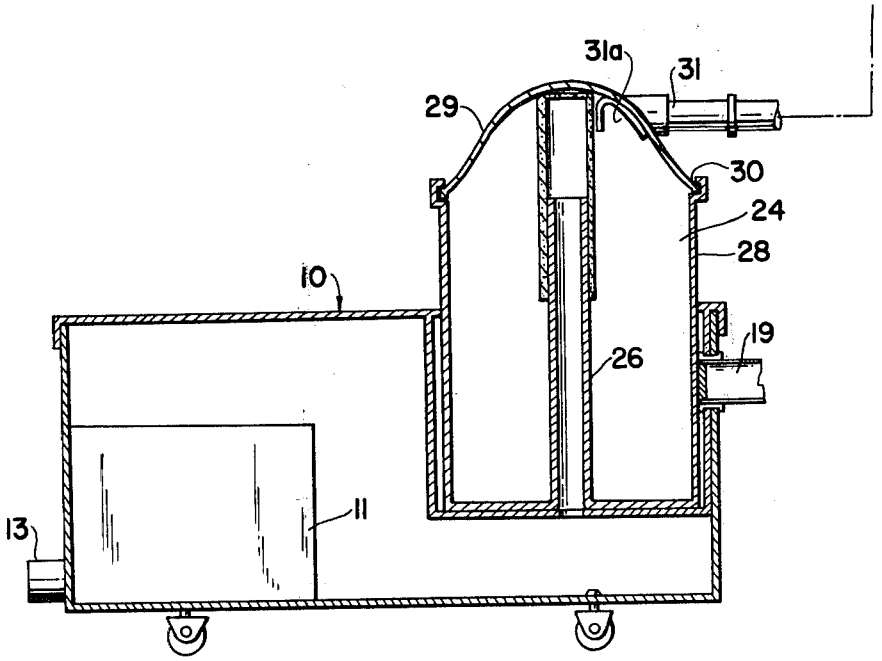
FIG. 8 is a side view partly in section of a modifed form of the cleaning device of the system of the present invention used as a hot water extraction unit.

For example, there is the modified form of the invention as illustrated in FIGS. 7 and 8. In describing this embodiment in order to facilitate understanding, the same numbers will be used to identify parts which are identical with those parts illustrated in FIGS. 1–6. In FIGS. 7 and 8, there is the housing 10, the vacuum means 11 and the exhaust 13 all of which perform the same functions as hereinbefore described. An access opening 12 is also provided on one section of the housing 10 and is coverable by the cover 17.

However, as illustrated, the second compartment in the housing is formed by a receptacle 40. The inlet 19 extends into the side wall of the housing. In this embodiment an inlet opening 41 is provided in the side wall of the receptable at a point adjacent to the inlet 49 in the housing 10. The base 42 of the receptacle 40 has a central aperture 43 providing condition transmitting means between the interior or the housing and the compartment or receptacle 40. The base portion 42 of the housing serves as a juncture surface as hereinafter described. The base of the receptacle may optionally contain cushioning means (not shown) which also would have a single aperture to be aligned with the aperture 43 in the base of the receptacle.

When the vacuum motor is operated through a conventional electrical outlet (not shown), it is of suitable strength to cause a vacuum to be created within the entire interior of the relatively air tight housing 10. By means of the aperture 43, this vacuum condition is also created within the receptacle 15 causing the air and accompanying dirt and debris to be drawn from the rug or other surfaces through the vacuum tool and the inlet 19 into the bag 21 whereupon the rug or other surfaces may be dry vacuum cleaned.

When it is desired to use this modified form of the invention for wet cleaning as a hot water extraction unit, the cover 17 is removed from the receptacle 40 and a wet recovery vacuum tank 24 is inserted into the receptacle. When this use is contemplated, the inlet 19 may be closed by means of a cap 25 or other suitable means. The recovery tank 24 is like the above described tank and has an internal riser tube 26 extending from an aperture 27 in the base of the tank. The tank is so disposed that it fits snugly within the interior of the receptacle 15, at least at the bottom portion thereof with the opening 27 at the base of the tank aligned with both the cushioning means aperture 23 and the opening 17 at the base of the housing leading into the interior of the recovery tank. Thus, a juncture is established between the surface area of the tank 24 surrounding the opening 27 and the opposing surface area of the receptacle 40 surrounding the aperture 43 therein. The tank comprises two portions, i.e. a lower portion or base 28 and a removable cover 29, both of which may be made of any suitable material. A sealing ring 30 is provided at the joinder of the cover and the base of the tank for preventing the ingress of air at the juncture of these two parts.

An inlet 31 is disposed, preferably within the cover, as shown. The outer end of the inlet 31 is connected to the water extractor 32 in the manner illustrated and described above with reference to FIG. 4.

The system of the invention as shown in this embodiment of the invention fundamentally operates as the operation set forth in detail in connection with FIGS. 1–6. The receptacle 40 thus, in effect, becomes the second compartment as above described. The vacuum conditions in the remainder of the housing (the first compartment) are transmitted to the receptacle through aperture 43 and when a vacuum tank 24 is used through the aligned aperture in the riser 26.

It will thus be seen that a compact easily manipulatable cleaning system has been presented by the present invention which is compact in size and extremely efficient in operation. The unit is useable in everyday use and only the simple insertion of a recovery tank into a portion of the unit converts it into a hot water extraction unit utilizing the same basic structure. There is thus presented a minimum of parts to obtain the highly desirable results.

Accordingly, the vacuum extraction recovery system assembly contemplates an overall construction and arrangement involving a compartmentalized vacuum housing 10 having a substantially air tight exterior wall and an interior which is bounded from below by a bottom floor portion and which includes a first lateral interior portion in which the means for creating a vacuum or vacuum motor 11 is disposed and a second lateral interior portion disposed upwardly of such bottom floor portion.

With regard to FIGS. 1–4, such assembly includes wall surface means 16, containing at least one constantly, directly and continuously freely independently open flow aperture **16*a* therein and defining together with an adjacent portion of the exterior wall of the housing 10 thereat an interior vacuum compartment 15 disposed in the second lateral portion of the housing interior and laterally remotely spaced from the means for creating a vacuum 11 disposed in the first lateral portion of the housing interior and in constant, direct and continuous freely independently open flow communication with the remainder of the housing interior, as at interior vacuum compartment 14, through such flow aperture 16*a*. Compartment 15 is thereby constantly, directly and continuously maintained by such flow aperture 16*a* under vacuum condition corresponding to that in the remainder of the housing interior upon creating a vacuum in the housing by such means 11**.

In this regard, removable flow communicating closure insert means, e.g. tank 24, are provided for insertion in the access opening 12 in the exterior wall of the housing which directly communicates with the interior vacuum compartment 15. Such closure insert means therby close off the compartment 15 from the exterior of the housing and prevent direct flow communication through the access opening 12 between the exterior of the housing and compartment 15. Exterior inlet means 31 and interior outlet means, as at aperture 27 in the base of tank 24, are appropriately contained on the closure insert means and disposed in flow communication with each other through such closure insert means, with the inlet means being adapted for flow connection with an external vacuum extraction recovery hose and arranged for flow communicating the exterior of the housing with the flow aperture **16*a* of the wall surface means 16 through the closure insert means, outlet means as at aperture 27, and interior vacuum compartment 15**.

Spacing support means 18 in the housing interior, e.g. upwardly extending support members on the bottom floor portion for engaging the portion of the closure insert means adjacent the outlet means thereof, are in turn provided for maintaining the outlet means of the closure insert means in raised open flow relation to the bottom floor portion of the housing interior. Hence, upon creating a vacuum by the means for creating a vacuum 11, a corresponding condition is constantly, directly and continuously maintained in the interior vacuum compartment 15 laterally remotely spaced therefrom and in turn at the inlet means 31 for recovery in the assembly of vacuum extracted material, inherently either wet or dry as desired, entering through the inlet means.

With regard to FIGS. 7-14 8, the like parts to those in FIGS. 1–4 are contemplated in the assembly, but in this instance the wall surface means, compartment and flow aperture correspond to parts 42, 40 and 43, whereas the spacing support means constitutes a vicinal portion of the wall surface means 42. More specifically, the outlet means of the closure insert means, as at aperture 27, may be suitably arranged for direct abutment juncture flow registry with the flow aperture 43 such that the spacing support means in turn constitute a portion of the wall surface means 42 adjacent the flow aperture 43 and disposed in raised open flow relation to the bottom floor portion.

In either instance, the arrangement will inherently provide a laterally extended open flow path from the outlet means, as at aperture 27, and/or the appropriate open flow aperture **16*a* or 43 to the laterally remote vacuum creating means 11**, due to the raised open flow relation of the contemplated associated parts to the bottom floor portion, the freely independently open nature of such outlet means and/or flow aperture and the extended lateral flow path therefrom to the relatively remotely located vacuum creating means.

Stated another way, the vacuum extraction recovery system assembly contemplates an overall construction and arrangement involving a compartmentalized housing 10 having a substantially air tight exterior wall and which includes a first lateral interior portion in which the means for creating a vacuum or vacuum motor 11 is disposed and a second lateral interior portion, plus compartmentalizing flow path means for providing a first vacuum compartment containing such means for creating a vacuum and a second vacuum compartment containing entrance means flow communicating with the housing exterior and adapted for flow connection with an external vacuum extraction recovery hose and exit means disposed in the second lateral portion of the housing interior in laterally remotely spaced relation to such vacuum creating means 11, such that the compartmentalizing flow path means define an extended lateral constantly, directly and continuously freely independently open flow path from the exit means to the vacuum creating means.

Figure 2:
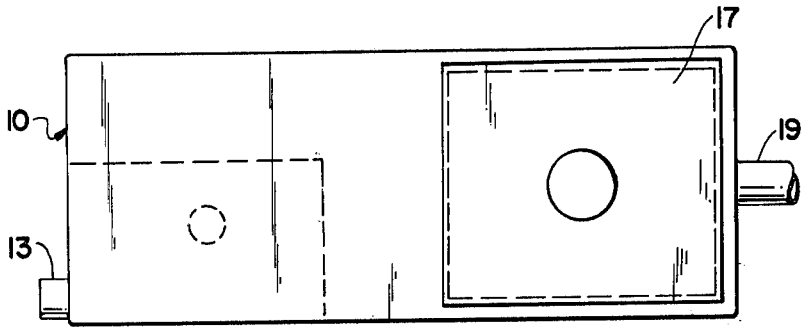
FIG. 2 is a plan view of the cleaning device of the system of the present invention.
Figure 3:
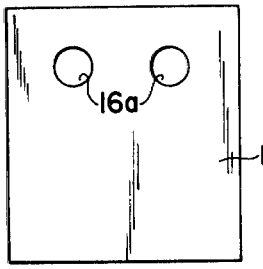
FIG. 3 is a side view of the dividing wall which compartmentalizes the cleaning device of the system of the present invention.

With regard to FIGS. 1–3, such assembly includes as the compartmentalizing flow path means the wall surface means or wall 16 for providing a first vacuum compartment 14 containing the vacuum creating means 11 and a second vacuum compartment 15 containing entrance means 19 for flow communicating with the exterior of the housing and adapted for flow connection with an external vacuum extraction recovery hose and exit means **16*a* disposed in the second lateral portion of the housing interior in laterally remotely spaced relation to the vacuum creating means 11. Such associated structure defines an extended lateral constantly, directly and continuously freely independently open flow path from the exit means 16a to the vacuum creating means 11**.

With regard to FIG. 4, such assembly includes as the compartmentalizing flow path means the removable substantially air tight emptiable vacuum tank 24 for providing a first vacuum compartment, i.e as constituted by the corresponding interior of the housing per se, containing the vacuum creating means 11, and a second vacuum compartment, i.e. as constituted by the tank 24 per se, having an exterior portion containing the entrance means 31 for flow communicating with the exterior of the housing and adapted for flow connection with an external vacuum extraction recovery hose and an interior portion containing exit means, as at aperture 27 in the base of tank 24, and operatively disposed in the second lateral portion of the housing interior in laterally remotely spaced relation to the vacuum creating means 11. Such associated structure, with the tank in flow communication with the interior of the housing, defines an extended lateral constantly, directly and continuously freely independently open flow path from the exit mens, as at aperture 27, to the vacuum creating means 11.

With regard to FIG. 7, such assembly includes as the compartmentalizing flow path means the wall surface means or wall 42 for providing a first vacuum compartment 14 containing the vacuum creating means 11 and a second vacuum compartment 15 containing entrance means 19 for flow communicating with the exterior of the housing and adapted for flow connection with an external vacuum extraction recovery hose and exit means 43 disposed in the second lateral portion of the housing interior in laterally remotely spaced relation to the vacuum creating means. Such associated structure defines an extended lateral constantly, directly and continuously freely independently open flow path from the exit means 43 to the vacuum creating means 11.

With regard to FIG. 8, such assembly includes as the compartmentalizing flow path means the wall surface means or wall 42 in conjunction with the aforesaid tank 24 for providing a first vacuum compartment 14 containing the vacuum creating means 11, and a second vacuum compartment, i.e. as constituted by the tank 24 per se situated in abutment juncture contact relation with such wall 42, having an exterior portion containing the entrance means 31 for flow communicating with the exterior of the housing and adapted for flow connection with an external vacuum extraction recovery hose and an interior portion containing exit means, as at aperture 27 in the base of tank in association with the exit aperture 43 in wall 42 in abutment juncture contact flow registry therewith, and with the tank operatively disposed in the second lateral portion of the housing interior in laterally remotely spaced relation to the vacuum creating means. Here also, the associated structure, with the tank in flow communication with the interior of the housing, defines an extended lateral constantly, directly and continuously freely independently open flow path from the conjoint exit means, as at aperture 27 in association with the exit aperture 43, to the vacuum creating means 11.

In these various instances, due to the positional association and disposition of the particular compartmentalizing means, upon creating a vacuum by the means for creating a vacuum 11, a corresponding vacuum condition is constantly, directly and continuously maintained along the extended lateral flow path, in the second vacuum compartment 15 and/or 24, or 40 and/or 24, as the case may be, and in turn at the entrance means 19 and/or 31, as the case may be, for recovery in the assembly of vacuum extracted material, inherently either wet or dry as desired, entering through such entrance means.

It will be appreciated in all instances that the open flow path and laterally remote relation between the above-noted corresponding outlet means or exit means, as the case may be, and the vacuum creating means 11 will inherently act to protect the vacuum creating means from otherwise contamination by extracted materials suspended or entrained in the air flow traveling through the system perforce in direct relation to the extent of remoteness involved while at the same time permitting unhindered suction air flow along such open flow path.

While the invention has been described in detail utilizing a specific example, it is to be understood that variations and modifications may be made without in any way departing from the spirit of the invention as defined in the appended claims.

What is claimed is:

1. Vacuum extraction recovery system assembly comprising a compartmentalized vacuum housing having a substantially air tight exterior wall and an interior which is bounded from below by a bottom floor portion and which includes a first lateral interior portion and a second lateral interior portion disposed upwardly of such bottom floor portion, means for creating a vacuum disposed in the first lateral portion of the interior of the housing, wall surface means containing a constantly freely open flow aperture therein and defining together with an adjacent portion of the exterior wall of the housing thereat an interior vacuum compartment disposed in the second lateral portion of the interior of the housing and laterally remotely spaced from the means for creating a vacuum disposed in the first lateral portion of the interior of the housing and in constant, and freely open flow communication with the remainder of the interior of the housing through the flow aperture and said interior vacuum compartment is thereby constantly maintained by such freely open flow aperture under vacuum condition corresponding to the vacuum condition in the remainder of the interior of the housing upon creating a vacuum in the housing by the means for creating a vacuum, a closable access opening in the exterior wall of the housing and directly communicating with the interior vacuum compartment, removable flow communicating closure insert means for insertion in the access opening for closing off the interior vacuum compartment from the exterior of the housing and for preventing direct flow communication through the access opening between the exterior of the housing and the interior vacuum compartment, exterior inlet means and interior outlet means contained on the closure insert means and disposed in flow communication with each other through the closure insert means, said inlet means being adapted for flow connection with an external vacuum extraction recovery hose and arranged for flow communicating the exterior of the housing with the flow aperture of the wall surface means through the closure insert means, the outlet means, and interior vacuum compartment, and spacing support means in the interior of the housing for maintaining the outlet means of the closure insert means in raised open flow relation to the bottom floor portion of the interior of the housing, whereby upon creating a vacuum by the means for creating a vacuum, a corresponding vacuum condition is constantly maintained in the interior vacuum compartment laterally remotely spaced therefrom and in turn at the inlet means for recovery in the assembly of vacuum extracted material entering through the inlet means.

2. System according to claim 1 wherein the closure insert means include a substantially air tight vacuum recovery tank having an exterior portion containing the inlet means and an interior portion containing the outlet means for flow communicating the exterior of the assembly through the tank and the flow aperture of the wall surface means with the remainder of the interior of the housing.

3. System according to claim 2 wherein the outlet means includes an internal riser tube positioned in the tank.

4. System according to claim 2 wherein the tank includes a base containing the outlet means and a removable cover containing the inlet means, and the base and cover are disposed in substantially air tight relation with each other.

5. System according to claim 4 wherein a sealing ring is interposed between the tank base and tank cover to maintain a substantially air tight relation therebetween.

6. System according to claim 4 wherein the outlet means includes an internal riser tube positioned in the tank.

7. System according to claim 1 wherein the spacing support means includes upwardly extending support members on the bottom floor portion for engaging the portion of the closure insert means adjacent the outlet means thereof.

8. System according to claim 1 wherein the outlet means of the closure insert means are arranged for direct abutment juncture flow registry with the flow aperture and the spacing support means includes a portion of the wall surface means adjacent the flow aperture and disposed in raised open flow relation to the bottom floor portion.

9. Vacuum extraction recovery system assembly comprising a compartmentalized vacuum housing having a substantially air tight exterior wall and which includes a first lateral interior portion and a second lateral interior portion, means for creating a vacuum disposed in the first lateral portion of the interior of the housing, compartmentalizing flow path means for providing a first vacuum compartment containing the means for creating a vacuum and a second vacuum compartment containing entrance means flow communicating with the exterior of the housing and adapted for flow connection with an external vacuum extraction recovery hose and exit means disposed in the second lateral portion of the interior of the housing in laterally remotely spaced relation to the means for creating a vacuum, said compartmentalizing flow path means defining an extended lateral constantly and freely open flow path from the exit means to the means for creating a vacuum, and said compartmentalizing flow path means including a removable substantially air tight emptiable vacuum tank having an exterior portion containing the entrance means and an interior portion containing the exit means and operatively disposed at the second lateral portion of the interior of the housing in flow communication with the interior of the housing and defining therewith the extended lateral constantly and freely open flow path from the exit means to the means for creating a vacuum, whereby upon creating a vacuum by the means for creating a vacuum, a corresponding vacuum condition is constantly maintained along the extended lateral flow path, in the second vacuum compartment and in turn at the entrance means for recovery in the assembly of vacuum extracted material entering through the entrance means.

* * * * *